US006500596B2

(12) United States Patent
Tanabe et al.

(10) Patent No.: US 6,500,596 B2
(45) Date of Patent: Dec. 31, 2002

(54) METHOD FOR PRODUCING AN ELECTROSTATIC IMAGE DEVELOPING TONER

(75) Inventors: Takayuki Tanabe, Kanagawa (JP); Akifumi Nemoto, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 41 days.

(21) Appl. No.: 09/790,637

(22) Filed: Feb. 23, 2001

(65) Prior Publication Data

US 2002/0004176 A1 Jan. 10, 2002

(30) Foreign Application Priority Data

Feb. 29, 2000 (JP) ..... 2000-053145
Mar. 31, 2000 (JP) ..... 2000-096750

(51) Int. Cl.[7] ..... G03G 5/00
(52) U.S. Cl. ..... 430/137.14
(58) Field of Search ..... 430/137.14

(56) References Cited

U.S. PATENT DOCUMENTS 4,146,690 A 3/1979 Tago et al.
6,030,739 A 2/2000 Ishikawa et al.
6,255,029 B1 * 7/2001 Hirose et al. ..... 430/108.23

FOREIGN PATENT DOCUMENTS

JP 9258479 10/1997
JP 11060739 3/1999
JP 11231570 8/1999

* cited by examiner

*Primary Examiner*—Mark A. Chapman
(74) *Attorney, Agent, or Firm*—Oblon, Spivak, McClelland, Maier & Neustadt, P.C.

(57) ABSTRACT

An method for producing an electrostatic image developing toner is prepared by a process comprising, stirring a dispersion containing at least primary polymer particles and coloring agent particles in a stirring tank, thereby agglomerating the particles, wherein the shape of the liquid level during the stirring operation satisfies the following formula (I) and (II):

$$H_C \leqq 0.8H \quad \text{(I)},$$

$$1.2H \leqq H_E \quad \text{(II)}$$

H: the distance between the bottom of the stirring tank at the its center and the horizontal plane of the surface of the dispersion before the start of the stirring, $H_C$: the distance between the bottom of the stirring tank at the its center and the liquid level of the surface of the dispersion at the its center during stirring, and $H_E$: the distance between the bottom of the stirring tank at the its center and the liquid level of the surface of the dispersion at the edge of the tank during stirring.

40 Claims, 4 Drawing Sheets

METHOD FOR PRODUCING AN ELECTROSTATIC IMAGE DEVELOPING TONER

BACKGROUND OF THE INVENTION

1. Field of the Invention

The present invention relates to a method for producing an electrostatic image developing toner which is useful in used electrophotographic system copying machines and printers. More particularly, the invention relates to a method for producing an electrostatic image developing toner, which comprises conducting particle size control in an agglomeration step to prepare toner particles having a sharp particle size distribution with a lower content of fine powder and coarse grains.

2. Discussion of Background

A conventional electrostatic image developing toner which has been widely used in the field of electrophotography is produced by melt-kneading a mixture comprising a coloring agent such as carbon black or a pigment, wax and/or a magnetic material with a resin (polymer) by an extruder, followed by pulverization and classification. However, by using this method, it is difficult to disperse the coloring agent and the compounding agent in the resin.

On the other hand, in recent years there has been a need for printers and copying machines having improved performance with respect to high picture quality and a high printing speed. To achieve a high picture quality, the toner is required to consist of small particle sizes ranging from 3 to 9 $\mu$m and a narrow particle size distribution. Further, to achieve a high printing speed, the toner is required to have a high fixation rate, i.e. it should be able to be fixed at a low temperature, as a toner physical property. Such are also favorable from the viewpoint of providing an environmental printer or copying machine which shortens the standby time, which does not generate much heat, and which has a small electric power consumption.

In order to achieve fixation of the toner at a low temperature, the softening point of the resin should be lowered. However, the conventional toner obtained by the melt-kneading/pulverization method has an antinomic relation such that when the softening point of the resin is lowered, the fixation property at low temperature will be improved, but at the same time, the Tg of the toner tends to be low, and the blocking resistance tends to be impaired. Namely, it is impossible to control the dispersion of the materials, and the structure control which satisfies both the blocking resistance and the fixation property at low temperature is extremely difficult.

A method of mixing an additive such as wax in the toner formulation is known, but the added amount of the additive is limited to a level of from 4 to 5 parts by weight based on 100 parts by weight of the resin, and the fixation characteristic of the toner at a low temperatures tends to be inadequate when the additive is incorporated in the toner in such amounts. Further, when flakes obtained by melt-kneading are mechanically pulverized to prepare a toner, the yield tends to be poor, and the particle size distribution tends to be broad.

Particularly when it is attempted to obtain a toner having small particle sizes, this tendency is very significant.

In recent years, the known production method of producing polymer toner by-means of emulsion polymerization or suspension polymerization is expected to take the place of the melt-kneading/pulverization method. By these methods, it is possible to control the dispersion of the materials in a manner which is different from the melt-kneading/pulverization method. Further, it is also possible to prepare a toner having small particle sizes and a good particle size distribution. Particularly by the emulsion polymerization agglomeration method, it is possible to control the particle size, the particle size distribution and the shape of the toner.

In the case of producing a toner by the emulsion polymerization method, a pigment and a charge controlling agent are added to a dispersion of an emulsified resin, containing primary resin particles having particle sizes of ranging from 0.05 to 0.5 $\mu$m obtained by polymerization, and also e.g. an electrolyte to agglomerate the primary particles thereby preparing a toner of a particle size ranging from 3 to 9 $\mu$m. The slurry obtained containing the toner particles is washed and dried thereby preparing toner particles as a product. However, it is difficult to prepare toner particles having a uniform particle size in the agglomeration step even by this method. Stirring plays an important role in the agglomeration of the primary particles. That is, in the agglomeration step, the viscosity of the mixture changes as the particles agglomerate. Accordingly, it is necessary to control the agglomeration of particles by changing the-rate of stirring the mixture as the viscosity of the medium changes during agglomeration. However, no method has been proposed which adequately controls the agglomeration of particles. Accordingly, it is difficult prepare a uniform toner having small particle sizes even by emulsion polymerization/agglomeration, and it is necessary to further e.g. process the agglomerated particles such as by classification after the agglomeration step to achieve the desired performance of the toner.

SUMMARY OF THE INVENTION

Accordingly, one object of the present invention is to provide a method of preparing toner particles having small particle sizes and a sharp particle size distribution, suitable to achieve a high picture quality and a high printing speed, by agglomerating primary polymer particles prepared by e.g. emulsion polymerization.

It has now been found that the above objective can be achieved by controlling the stirring conditions during agglomeration of primary polymer particles under specific conditions with a view to uniformly mix the liquid containing the particles for agglomeration so that the agglomeration medium thickens during agglomeration, provides sharpness of the particle size distribution of the agglomerated particles and provides ease of particle size control.

Briefly, this object and other objects of the present invention as hereinafter will become more readily apparent can be attained by a method for producing an electrostatic image developing toner, which comprises, stirring a dispersion containing at least primary polymer particles and coloring agent particles in a stirring tank, thereby agglomerating the particles, wherein the shape of the liquid level during the stirring operation in the agglomeration step satisfies the following formulae (I) and (II):

$$H_C \leqq 0.8H \quad \text{(I)},$$

$$1.2H \leqq H_E \quad \text{(II)}$$

H: the distance between the bottom of the stirring tank at its center and the horizontal plane of the surface of the dispersion before the start of stirring, $H_C$: the distance between the bottom of the stirring tank at its center and the liquid level of the surface of the dispersion at its center during stirring, and $H_E$: the distance between the bottom of the stirring tank at its center and the liquid level of the surface of the dispersion at the edge of the tank during stirring.

Another aspect of the present invention is a method for producing an electrostatic image developing toner, which comprises, an agglomeration step of stirring a dispersion containing at least primary polymer particles and coloring agent particles in a stirring tank to prepare agglomerates of the primary particles and coloring agent particles, wherein a double helical ribbon blade is employed as the agitating blade within the stirring tank.

DETAILED DESCRIPTION OF THE PREFERRED EMBODIMENTS

Figure 1:
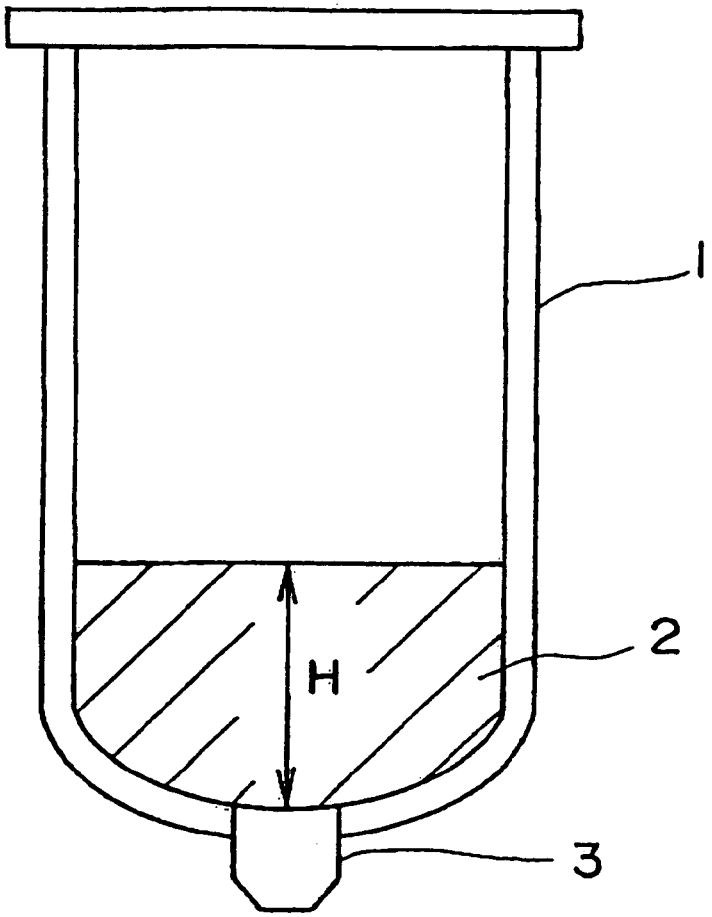
FIG. 1 illustrates a mixed dispersion (slurry) in a stirring tank in the unstirred state.

The toner of the present invention contains, as constituents primary polymer particles, and primary particles of a coloring agent, e.g. wax, a charge controlling agent, fine resin particles or another and other additives, as desired.

In the method of producing the toner of the present invention the agglomeration of particles is essential, and is preferably done by an emulsion polymerization/agglomeration method. The emulsion polymerization/agglomeration method usually comprises a polymerization step, a mixing step, an agglomeration step, an aging step and a washing/drying step.

That is, e.g. a coloring agent and a charge controlling agent are mixed into a dispersion containing primary polymer particles prepared by emulsion polymerization. The primary particles in the dispersion are agglomerated to form agglomerates of particles having a volume average particle size ranging from 3 to 9 $\mu$m. Fine resin particles are attached thereto as the case requires, and the agglomerates of particles or the agglomerates of particles having fine resin particles attached thereto are fused as desired, and the toner particles thus obtained are washed and dried to prepare toner particles as a product.

Polymer Primary Particles

The primary polymer particles to be used in the present invention are preferably particles having a glass transition temperature (Tg) ranging from 40 to 80° C. and an average particle size usually ranging from 0.02 to 3 $\mu$m. Usually, the primary polymer particles employed are obtained from a polymer dispersion prepared by emulsion polymerization of a monomer. The primary polymer particles are preferably produced by emulsion polymerization as explained below.

To conduct emulsion polymerization, polymerization is conducted by successively adding a monomer containing a Brønsted acidic group (hereinafter sometimes referred to simply as an acidic group) or a monomer having a Brønsted basic group (hereinafter sometimes referred to simply as a basic group), and a monomer having no Brønsted acidic group or Brønsted basic group (hereinafter sometimes referred to simply as another monomer). The monomers may be separately added to a polymerization medium, or a plurality of monomers may be first mixed and then added to a polymerization medium. Further, it is possible to change the monomer composition during the addition of the monomers. Still further, the monomer may be added as it is, or it may be added in the form of an emulsion obtained by first mixing water or an emulsifying agent therewith, followed by adjustment. As the emulsifying agent, one or more may be selected from surface active agents as mentioned hereinafter. In order to conduct the emulsion polymerization, a certain amount of an emulsifying agent (surface active agent) is added to the wax emulsion. Further, a polymerization initiator may be added to the system before the addition of the monomers, simultaneously with the addition of the monomers, or after the addition of the monomers, and a combination of such addition methods may also be employed. The monomer having a Brønsted acidic group may, for example, be a monomer having a carboxyl group such as acrylic acid, methacrylic acid, maleic acid, fumaric acid or cinnamic acid, a monomer having a sulfonic acid group such as sulfonated styrene, or a monomer having a sulfonamide group such as vinylbenzene sulfonamide.

The monomer having a Brønsted basic group may, for example, be a monomer containing a nitrogen-containing heterocyclic ring, such as an aromatic vinyl compound having an amino group such as aminostyrene, vinylpyridine or vinylpyrrolidone, or a (meth)acrylic ester having an amino group, such as dimethylaminoethyl acrylate or diethylaminoethyl methacrylate.

The monomer having an acidic group or the monomer having a basic group may be present as a salt with counter ions.

The proportion of such a monomer having a Brønsted acidic group or a Brønsted basic group, in the monomer mixture to prepare the primary polymer particles, is preferably at least 0.05 wt. %, more preferably at least 1 wt. %, and preferably at most 10 wt. %, more preferably at most 5 wt. %.

Another comonomer may, for example, be a styrene compound such as styrene, methylstyrene, chlorostyrene, dichlorostyrene, p-tert-butylstyrene, p-n-butylstyrene or p-n-nonylstyrene, a (meth)acrylic ester such as methyl acrylate, ethyl acrylate, propyl acrylate, n-butyl acrylate, isobutyl acrylate, hydroxyethyl acrylate, ethylhexyl acrylate, methyl methacrylate, ethyl methacrylate, propyl methacrylate, n-butyl methacrylate, isobutyl methacrylate, hydroxyethyl methacrylate or ethylhexyl methacrylate, acrylamide, N-propylacrylamide, N,N-dimethylacrylamide, N,N-dipropylacrylamide, N,N-dibutylacrylamide or amide acrylate. Among them, particularly preferred is e.g. styrene and butyl acrylate.

In the event a cross-linking resin is employed to prepare the primary polymer particles, the cross-linking agent to be used together with the above monomers may be a radical-polymerizable multifunctional monomer, examples of which include divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate and diallyl phthalate. Further, a monomer having a reactive group in a pendant group, such as glycidyl methacrylate, methylol acrylamide or acrolein may also be used.

A radical-polymerizable bifunctional monomer is preferred, and divinylbenzene or hexanediol diacrylate is more preferred.

The amount of such a multifunctional monomer in the monomer mixture is preferably at least 0.005 wt. %, more preferably at least 0.1 wt. %, particularly preferably at least 0.3 wt. %, and preferably at most 5 wt. %, more preferably at most 3 wt. %, particularly preferably at most 1 wt. %.

Such a monomer may be used alone or as mixed. Preferably the glass transition temperature of the polymer ranges from 40 to 80° C. If the glass transition temperature exceeds 80° C, the fixation temperature tends to be too high, or the transparency of OHP tends to deteriorate, and if it is less than 40° C., the storage stability of the toner may sometimes deteriorate. The polymerization initiator may, for example, be a persulfate such as potassium persulfate, sodium persulfate or ammonium persulfate; a redox initiator having such a persulfate as one component and a reducing agent such as acidic sodium sulfite as the other component; a water-soluble polymerizable initiator such as hydrogen peroxide, 4,4'-azobiscyano valeric acid, t-butyl hydroperoxide or cumene hydroperoxide; a redox initiator having such a water-soluble polymerization initiator as one component and a reducing agent such as a ferrous salt as the other component; benzoyl peroxide or 2,2'-azobisisobutyronitrile. The polymerization initiator may be added to the polymerization system before the addition of the monomers, simultaneously with the addition or after the addition, and a combination of such addition methods may also be employed as desired. In the present invention, a known chain transfer agent may be used as the case requires, specific examples of which include t-dodecyl mercaptan, 2-mercaptoethanol, diisopropyl xanthogen, carbon tetrachloride and trichlorobromomethane. The chain transfer agent may be used alone or in combination of at least two, and it is used in an amount ranging from 0 to 5 wt. % based on the polymerizable monomer.

The emulsion polymerization of the present invention is conducted by mixing the above monomers with water and polymerizing them in the presence of a polymerization initiator, and the polymerization temperature is usually from 50 to 150° C., preferably from 60 to 120° C., more preferably from 70 to 100° C.

The emulsion polymerization is conducted preferably in the presence of wax as described hereinafter.

The emulsifying agent used in the emulsion polymerization is at least one member selected from the group consisting of a cationic surface active agent, an anionic surface active agent and a nonionic surface active agent.

Specific examples of a cationic surface active agent include dodecylammonium chloride, dodecylammonium bromide, dodecyltrimethylammonium bromide, dodecylpyridinium chloride, dodecylpyridinium bromide and hexadecyltrimethylammonium bromide.

Specific examples of an anionic surface active agent include a fatty acid soap such as sodium stearate and sodium dodecanoate, dodecyl sodium sulfate, dodecyl sodium benzenesulfonate and sodium lauryl sulfate.

Specific examples of a nonionic surface active agent include polyoxyethylene dodecyl ether, polyoxyethylene hexadecyl ether, polyoxyethylene nonylphenyl ether, polyoxyethylene lauryl ether, polyoxyethylene sorbitan monooleate ether and monodecanoyl saccharose.

Of the surface active agents, preferred is an alkali metal salt of a linear alkylbenzene sulfonic acid.

The volume average particle size of the primary polymer particles usually ranges from 0.02 to 3 μm, preferably from 0.05 to 3 μm, more preferably from 0.1 to 2 μm, and particularly preferably from 0.1 to 1 μm. Here, the average particle size may be measured by means of UPA, for example. If the average particle size is less than 0.02 μm, it tends to be difficult to control the agglomeration rate, and if it is larger than 3 μm, the particle sizes of the toner obtained by agglomeration tend to be too large, and such a toner is not suitable for application where high resolution is required.

Coloring Agent

In the present invention, a dispersion of the primary polymer particles and coloring agent particles are mixed to prepare a mixed dispersion, followed by agglomeration to prepare agglomerates of particles. The coloring agent may be an inorganic pigment, an organic pigment or an organic dye, or a combination thereof. Specific examples include known pigments and dyes such as aniline blue, phthalocyanine blue, phthalocyanine green, Hansa yellow, a rhodamine type pigment or dye, chrome yellow, quinacridone, benzidine yellow, rose bengal, a triallylmethane type dye, a monoazo type, disazo type or condensed azo type pigment or dye. Such a pigment or dye may optionally be used alone or as a mixture. In the case of a full color toner, it is preferred to use benzidine yellow, a monoazo type or a condensed azo type pigment or dye for yellow, quinacridone or a monoazo-type pigment or dye for magenta, and phthalocyanine blue for cyan. The amount of the coloring agent usually ranges from 1 to 25 parts by weight, preferably from 3 to 20 parts by weight, based on 100 parts by weight of the primary polymer particles.

In the case where a coloring agent is emulsified in water in the presence of an emulsifying agent such as the above-described surface active agent, and used in the form of an emulsion, it is preferred to use a coloring agent having a volume average particle size ranging from 0.01 to 3 μm.

Wax

In the present invention, a wax is preferably present during agglomeration of the primary polymer particles as desired. Any known wax may be used. Suitable waxes include olefin type waxes such as a low molecular weight polyethylene, a low molecular weight polypropylene or a copolymerized polyethylene; paraffin wax; an ester type wax having a long chain aliphatic group such as behenyl behenate, a montanic ester or stearyl stearate; a vegetable type wax such as hydrogenated castor oil camauba wax; a ketone having a long chain alkyl group such as distearyl ketone; a silicone having an alkyl group; a higher fatty acid such as stearic acid; a long chain aliphatic alcohol such as eicosanol; a carboxylate or a partial ester of a polyvalent alcohol obtained from a long chain fatty acid and a polyvalent alcohol such as glycerol or pentaerythritol; a higher fatty acid amide such as an oleic acid amide or a stearic acid amide; or a low molecular weight polyester may, for example, be mentioned.

In order to improve the fixation property of the toner, the melting point of the wax usually ranges from 30 to 100° C., preferably at least 40° C., more preferably at least 50° C., and preferably at most 90° C., more preferably at most 80° C. If the melting point is too low, the wax tends to be exposed on the surface of the image after fixation, thus causing stickiness, and if the melting point is too high, the toner fixation at low temperatures tends to be poor.

Still further, when the wax is a compound, preferred is an ester type wax prepared from an aliphatic carboxylic acid and a monovalent or polyvalent alcohol, more preferred is an ester type wax having a carbon number of from 20 to 100, particularly preferred is one having a carbon number of from 30 to 60.

The above wax may be used alone, or the wax may be a mixture of two or more waxes. Further, the melting point of the wax compound may be selected on the basis of the fixation temperature at which the toner is fixed.

The amount of the wax usually ranges from 2 to 40 parts by weight, preferably from 5 to 20 parts by weight, based on 100 parts by weight of the primary polymer particles.

Preferably the wax is used as a dispersion of fine wax particles and is prepared by initially dispersing and emulsifying a wax in the presence of an emulsifying agent. The emulsifying agent to be used here may be one similar to the emulsifying agent to be used in the above emulsion polymerization.

The wax is present in the agglomeration step, and is preferably present in the primary polymer particles in order to uniformly disperse the wax in the toner. In order to prepare primary polymer particles containing the wax, the monomer of the polymer of the particles is polymerized in a dispersion of fine wax particles.

The average particle size of the fine wax particles preferably ranges from 0.01 to 3 μm, more preferably from 0.1 to 2 μm, particularly preferably from 0.3 to 1.5 μm. The average particle size may be measured by means of LA-500 manufactured by Horiba, Ltd. If the average particle size of the wax emulsion is larger than 3 μm, the average particle size of the polymer particles obtained by seed polymerization tends to be too large, and such polymer particles are not suitable for production of a toner having small particle sizes which enable high image resolution. Further, if the average particle size of the emulsion is smaller than 0.01 μm, it tends to be difficult to prepare the dispersion.

Charge Controlling Agent

In the present invention, a charge controlling agent may be incorporated into the toner as desired. In order to incorporate the charge controlling agent into the-toner, when the primary polymer particles are prepared, a charge controlling agent may be used as a seed together with a wax, a charge controlling agent may be dissolved or dispersed in a monomer or a wax, or primary particles of the charge controlling agent may be agglomerated together with the primary polymer particles to form agglomerates of particles to prepare the toner. However, it is preferred to attach or fix the primary particles of a charge controlling agent to agglomerates of particles before, simultaneously with or after the step of attaching or fixing the fine resin particles. In such a case, the charge controlling agent is preferably dispersed in water by using an emulsifying agent, which is the above-described surface active agent, and then used as an emulsion of the primary particles of a charge controlling agent having an average particle size ranging from 0.01 to 3 μm.

The charge controlling agent can be a known charge controlling agent used alone or in combination as a mixture. For example, a positive charge controlling agent may be a quaternary ammonium salt or a basic and electron donating metal substance, and a negative charge controlling agent may be a metal chelate, a metal salt of an organic acid, a metal-containing dye, a nigrosine dye, an amide group-containing compound, a phenol compound, a naphthol compound or its metal salt, a urethane linkage-containing compound, or an acidic or electro-attractive organic material.

When considering color toner applicability the charge controlling agent itself is colorless or has only such a pale color so as not to impair the color tone of the toner, it is preferred to use a quaternary ammonium salt compound as a positive charge controlling agent and to use a metal salt or metal complex of chromium, zinc or aluminum with salicylic acid or alkyl salicylic acid, a metal salt or metal complex of benzylic acid, an amide compound, a phenol compound, a naphthol compound, a phenolamide compound, or a hydroxynaphthalene compound such as 4,4'-methylenebis[2-[N-(4-chlorophenyl)amide]-3-hydroxynaphthalene] as a negative charge controlling agent.

The amount of the charge controlling agent when used is determined on the basis of the desired charge amount, but it is usually from 0.001 to 5 parts by weight, preferably from 0.003 to 2 parts by weight, more preferably from 0.01 to 1 part by weight, based on 100 parts by weight of the primary polymer particles.

Mixing Step

In the agglomeration step of the method of the present invention, the above-described primary polymer particles and coloring agent particles, and particles of a compounding ingredient such as a charge controlling agent or wax as desired the case requires, may simultaneously or successively be mixed and dispersed into the dispersion. However, it is preferred to initially prepare dispersions of the respective components, i.e. a dispersion of the primary polymer particles, a dispersion of the coloring agent particles, and as desired, a dispersion of a charge controlling agent or a dispersion of fine wax particles, and to mix them to prepare a mixed dispersion.

Further, the wax is preferably included in the primary polymer particles, i.e. the wax is incorporated in the toner by way of primary polymer particles prepared by emulsion polymerization using a wax as a seed. In this case, wax included in the primary polymer particles and fine wax particles which are not included in the primary polymer particles may be used together, but more preferably, substantially all the wax is included in the primary polymer particles.

Agglomeration Step

The mixed dispersion of particles of each component is agglomerated in the agglomeration. The agglomeration treatment is conducted in a stirring tank by means of 1) a heating method, 2) a method of adding an electrolyte or 3) a combination thereof.

When it is attempted to prepare agglomerates of particles having sizes close to the side of the toner by agglomerating the primary particles with stirring, the particle sizes of the agglomerates of particles are controlled by the balance between the cohesive force among particles and the shearing force resulting from stirring. The cohesive force of the primary particles can be increased by heating or by adding an electrolyte.

When agglomeration is effected by heating, the agglomeration temperature is specifically within the range of from (Tg−20° C.) to Tg, where Tg is the glass transition temperature of the primary polymer particles, preferably within the range of (Tg−10° C.) to (Tg−5° C.). Within the above temperature range, the primary particles can be agglomerated to toner particle of desired sizes without using an electrolyte. Further, in the case of conducting agglomeration by adding an electrolyte, the agglomeration temperature ranges preferably from 20 to 40° C., more preferably from 25 to 35° C. The Tg of the polymer primary particles of the present invention ranges preferably from 40 to 80° C.

In order to control the particle size so that the toner particles have specific particle sizes (3 to 9 μm), the mixed dispersion is held at a predetermined agglomeration temperature for at least 30 minutes, preferably at least 1 hour so that the toner particles have the desired particle sizes. The temperature may be raised to a predetermined temperature at a constant rate or in a stepwise manner.

When the case of conducting agglomeration by adding an electrolyte to the mixed dispersion, the electrolyte may be either an organic salt or an inorganic salt, but preferred is a monovalent or polyvalent metal salt. Specifically, NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$ or $C_6H_5SO_3Na$ may, for example, be mentioned. Among them, more preferred is an inorganic salt having a polyvalent metal cation of di- or higher valency.

The amount of the electrolyte varies depending upon the type of the electrolyte, but usually ranges from 0.05 to 25 parts by weight, preferably from 0.1 to 15 parts by weight, more preferably from 0.1 to 10 parts by weight, based on 100 parts by weight of a solid component in the mixed dispersion. If the amount of the electrolyte employed is much smaller than the above stated range, the agglomeration reaction tends to proceed slowly, fine particles of at most 1 μm tend to remain after the agglomeration reaction, and the average particle size of the prepared agglomerates of particles tends to be at most 3 μm. Further, if the amount of the electrolyte is much larger than the above range, the agglomeration tends to proceed quickly and is difficult to control, coarse grains of at least 25 μm tend to be present in the prepared agglomerates of particles, and the agglomerates tend to have irregular and unstable shapes.

The mixed dispersion is heated or an electrolyte is added so that the particles of each component agglomerate to form particle agglomerates. In the agglomeration step, it is to necessary to stir the mixed dispersion uniformly and considerably vigorously in order that particles of each component uniformly agglomerate, that the agglomerates of particles have small particle sizes, and to control the particle size distribution. However, in the agglomeration step of the emulsion polymerization/agglomeration method, the mixed dispersion is in the form of a slurry having particles of various components dispersed therein and has a relatively high viscosity, which makes it difficult to uniformly and very rigorously control the stirring.

It is characteristic of the present invention that the shape of the liquid level during agglomeration be adjusted within the limits defined by following formulae (I) and (II):

$$H_C \leqq 0.8H \quad \text{(I)},$$

$$1.2H \leqq H_E \quad \text{(II)}$$

H: the distance between the bottom of the stirring tank at its center and the horizontal plane of the dispersion before the start of the stirring, $H_C$: the distance between the bottom of the stirring tank at its center and the liquid level of the dispersion at the center portion of the tank during stirring, and $H_E$: the distance between the bottom of the stirring tank at its center and the liquid level of the surface of the dispersion at the edge of the tank during stirring.

The relation between H and $H_C$ is preferably such that $H_C \leqq 0.7H$, more preferably $H_C \leqq 0.5H$, most preferably $H_C \leqq 0.01H$.

Further, the relation between H and $H_E$ is preferably such that $1.3H \leqq H_E$, more preferably $1.5H < H_E$.

The value of $H_C$ may change with changes in viscosity of the dispersion during the agglomeration step in some cases. For example, in the case where the viscosity is relatively low at the beginning of the agglomeration and the viscosity becomes relatively high in the middle of the agglomeration, when the stirring force is constant, the value of $H_C$ tends to be low at the beginning of the agglomeration and increases in the middle of the agglomeration. Likewise, with respect to the value of $H_E$, in the case where the viscosity is relatively low at the beginning of the agglomeration and the viscosity becomes relatively high in the middle of the agglomeration, when the stirring force is constant, the value of $H_E$ tends to be high at the beginning of the agglomeration and decreases in the middle of the agglomeration.

In the present invention, the liquid level has to have a shape which satisfies formulae (I) and (II) in at least a part of the agglomeration step. However, the liquid level preferably has a shape which satisfies formulae (I) and (II) for at least 30 minutes after the temperature during stirring reaches (TG-20° C.), where Tg is the glass transition temperature of the polymer primary particles, in the case when agglomeration is conducted by heating, or at least 30 minutes after the addition of an electrolyte is started in the case when agglomeration is effected by adding an electrolyte. Further, in both cases, the liquid level more preferably has a shape satisfying formulae (I) and (II) at the start of the agglomeration step, specifically during the time when the temperature ranges from (Tg−25° C.) to (Tg−20° C.) in the case when conducting agglomeration by heating, or for 1 minute immediately before the start of addition of an electrolyte when conducting agglomeration by adding an electrolyte.

More preferably, formulae (I) and (II) are satisfied for most of the integrated time of the agglomeration step, including the case when the liquid level is horizontal for a moment when the stirring direction is reversed, for example. Most of the integrated time is specifically at least 70% of the integrated time, more preferably at least 80%, most preferably at least 90%. Accordingly, in the case where the viscosity changes in the middle of the agglomeration step, it is essential to control the stirring force so that the shape of the liquid level satisfies the above formulae (I) and (II) during most of the agglomeration step.

The shape of the liquid level which satisfies formulae (I) and (II) can be further understood by reference to the Figures. FIG. 1 illustrates the liquid level of a mixed dispersion 2 (slurry) when the mixed dispersion is not stirred, and the liquid level is horizontal. Here, the stirring tank 1 preferably has a conventional approximately cylindrical or approximately spherical shape. In the case where the stirring tank is approximately cylindrical, the bottom of the tank does not have to have a particular shape, but a conventional approximately arcuate one is normally used. FIG. 1 illustrates a typical favored container having outlet 3.

Further, the ratio of the height of the stirring tank (overall height in the inside of the tank: L) to the width (overall width: D) is preferably L:D=5:1 to 1:2, more preferably L:D=4:1 to 1:1.

The shape of the stirring tank is normally cylindrical. However, the basic cylindrical shape can be off-cylindrical in the sense that its vertical confining structure is of an arcuate or bulging shape.

Further, a baffle may be provided in the stirring tank depending upon the shape of an agitating blade to be used, and it is preferred to use an agitating blade having no central axis and to provide a baffle on the inside of the agitating blade.

In order to obtain high stirring efficiency, the volume of the mixed dispersion is preferably at most two thirds of the volume of the stirring tank, more preferably at most half. Further, if the volume of the mixed dispersion is extremely small in comparison to the volume of the reaction solution, bubbling tends to be intense and thickening tends to be significant, coarse particles are likely to form, the mixed dispersion may not be stirred in some cases depending upon the shape of the agitating blade, and the production efficiency tends to decrease. Accordingly, the ratio is preferably at least 1/10, more preferably at least 1/5.

Figure 2:
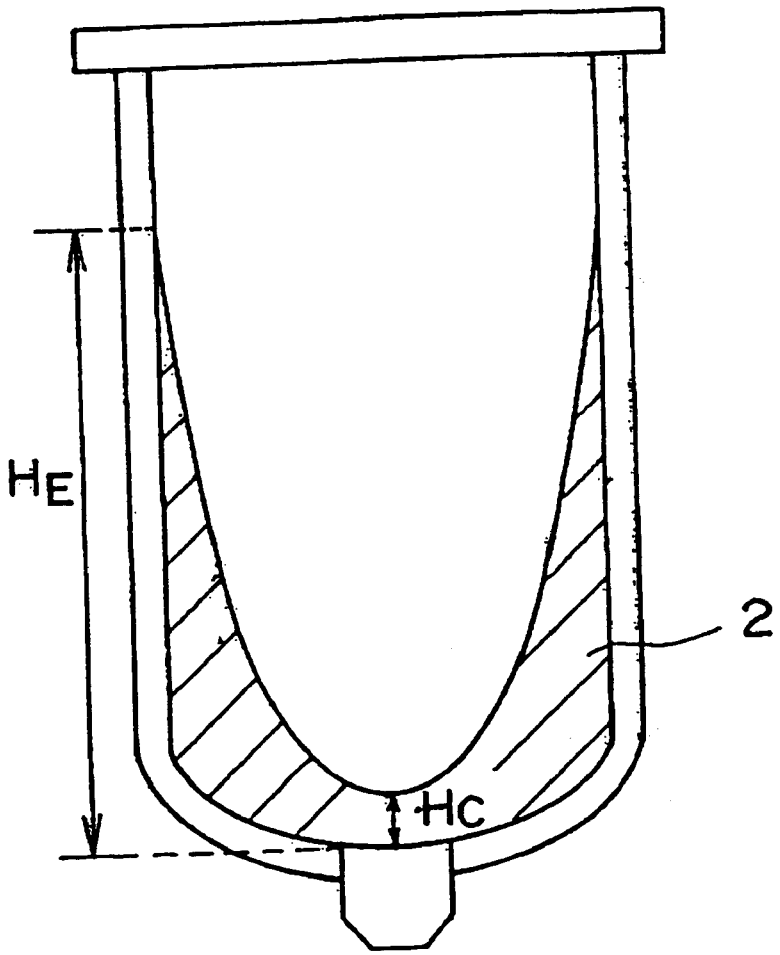
FIG. 2 illustrates a mixed dispersion stirred without bubbling, in a stirring tank, as one embodiment of the method of producing the agglomerated particles of toner of the present invention.
Figure 3:
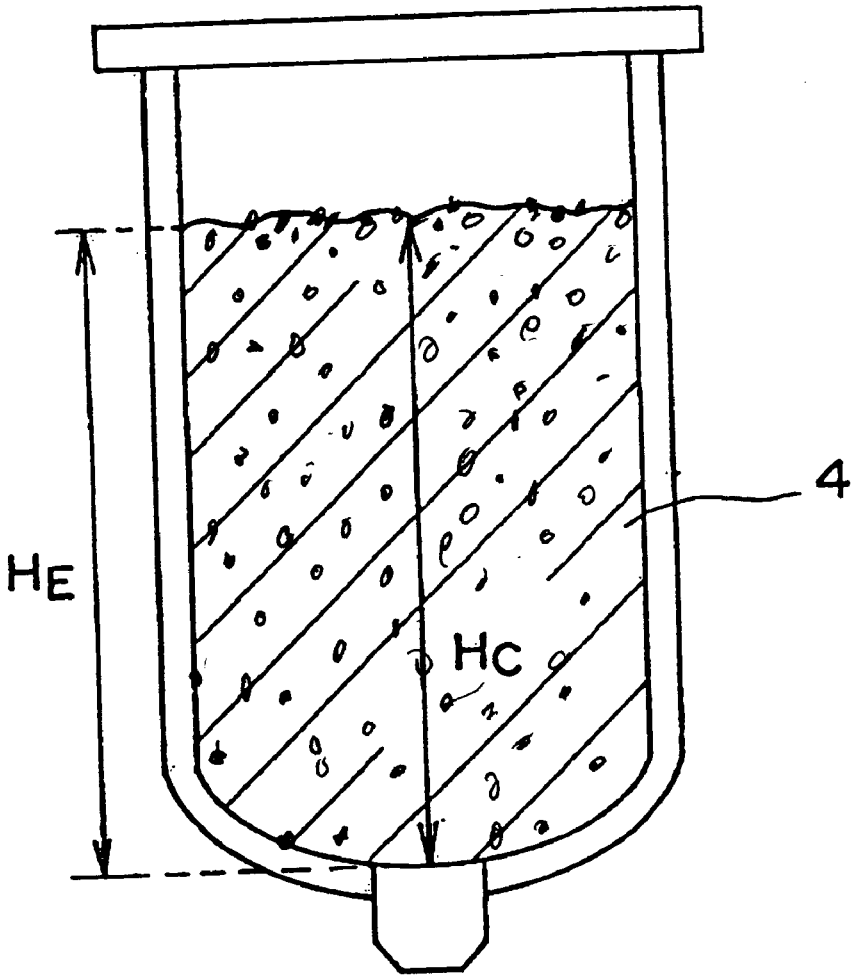
FIG. 3 illustrates a mixed dispersion, which is bubbled, in a stirring tank.
Figure 4:
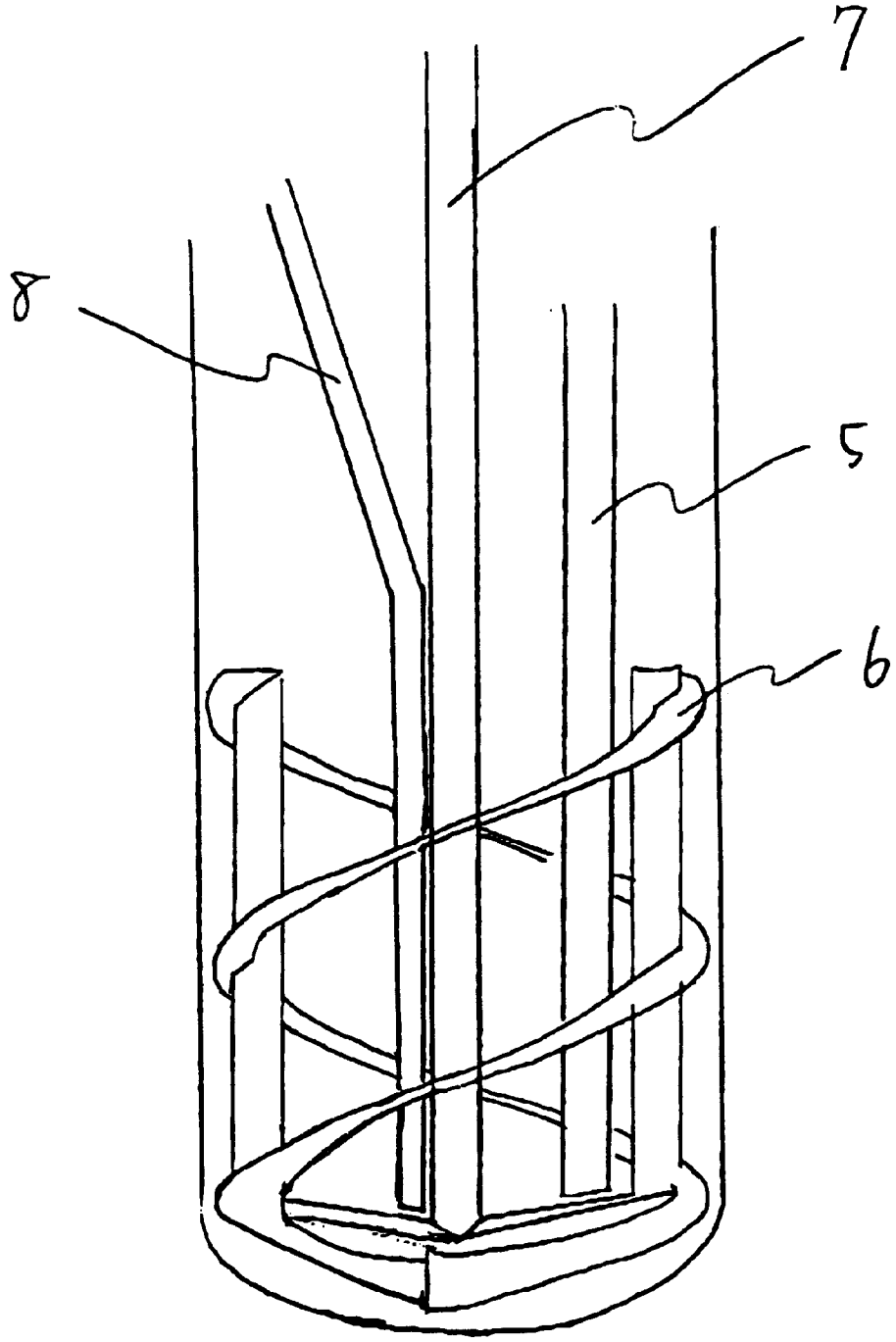
FIG. 4 is a schematic drawing illustrating a reaction apparatus comprising an approximately cylindrical stirring tank equipped with a double helical ribbon blade and a baffle, as one a preferred embodiment of preparing the agglomerated particles of toner of the present invention.

FIG. 2 illustrates an example of the liquid level of a mixed dispersion in the state of being stirred. Usually when a reaction liquid is stirred, it has such its shape is such that the liquid level is low at its center and the liquid level is high at the edge of the tank, as shown in FIG. 2. However, during production of a toner by the emulsion polymerization/agglomeration technique, as mentioned above, the particles of each component are dispersed and the viscosity of the liquid is increased, whereby the liquid is likely to involve the air during stirring and tends to bubble by the usual stirring methods (FIG. 3). In FIGS. 3, 4 indicates a bubbled mixed dispersion. a the stirred state as shown in FIG. 3, the mixed dispersion in the vicinity of the agitating blade alone is stirred, and the mixed dispersion distant from the agitating blade is hardly stirred. Accordingly, the mixed dispersion is not uniformly stirred, and a toner having a broad particle size distribution tends to be obtained. Accordingly, it is necessary to control the stirring state as shown in FIG. 2 even in the event of a slurry.

In formulae (I) and (II) will be explained below. H represents the distance between the bottom of the stirring tank at its center and the stationary horizontal plane of the mixed dispersion, when it is not stirred, and is shown in FIG. 1. In the case where an outlet or the like is disposed on the bottom of the stirring tank at its center portion, the distance from the horizontal plane of the mixed dispersion is measured from the substantial bottom of the container, not from the bottom of e.g. the outlet of the tank.

Here, H represents the distance between the bottom of the stirring tank at its center and the stationary horizontal plane of the surface of the mixed dispersion, when the dispersion is not stirred. The liquid level of the unstirred liquid is measured before stirring when a mixed dispersion containing the primary polymer particles, a coloring agent, a wax and a charge controlling agent is introduced into the stirring tank. Further, in the case when a component such as a dispersion of a charge controlling agent is introduced into the tank in the middle of the stirring operation, H represents the distance between the bottom of the stirring tank at its center and the stationary horizontal plane of the surface of the mixed dispersion upon estimation of the time that all the mixed dispersion is introduced into the stirring tank.

$H_C$ is the distance between the bottom of the stirring tank at its center and the liquid level of the mixed dispersion at its center during stirring, and $H_E$ is the distance between the bottom of the stirring tank at its center and the liquid level of the surface of the mixed dispersion at the edge of the tank during stirring. These conditions are shown in FIGS. 2 and 3. In the case where e.g. an outlet is disposed at the bottom of the stirring tank at the center of the tank portion, these distances from the liquid level of the mixed dispersion are measured from substantially the bottom of the container, not from the bottom of e.g. the outlet.

Further, in the case where the of a mixed, bubbled dispersion, the liquid level has the shape as shown in FIG. 3, and the distances ($H_C$ and $H_E$) between the liquid level and the bottom of the stirring tank at its center are measured including bubbled portions. Accordingly, in the case where the rotation rate of the agitating blade is insufficient and the stirring force is not adequate, and in the case where the mixed dispersion is not uniformly stirred due to bubbling, are distinguished from the production conditions of the present invention by the failure of these states to meet the conditions of formulae (I) and (II).

The reason why the method of the present invention has the above-desired excellent effects is not clear. However, it is believed that a network is formed and thickening takes place during agglomeration, the particle sizes are determined by the intensity of the shearing force of the agitating blade, and the particle size distribution is determined by mixing uniformity during thickening. Accordingly, it is believed that mixing uniformity is secured by employing stirring conditions which satisfy formulae (I) and (II) where bubbling is suppressed and a considerable shearing force is maintained.

Agitating Blade

With regard to the agitating blade which is used in the stirring tank, known and commercially available agitating blades having various shapes may be used so long as the stirring conditions of formulae (I) and (II) are satisfied.

A commercially available agitating blade may, for example, be an anchor blade (manufactured by Mitsubishi Chemical Corporation), a Fulzone Blade (manufactured by Shinko Pantec Co., Ltd.), a Summeller Blade (manufactured by Mitsubishi Heavy Industries, Ltd.), a Maxblend Blade (manufactured by Sumitomo Heavy Industries, Ltd.), a Hi—F mixer Blade (manufactured by Soken Chemical and Engineering Co., Ltd.), a Double Helical Ribbon Blade (manufactured by Shinko Pantec Co., Ltd.) or a Double helical Blade equipped with a baffle. Usually, the agitating blade is selected from the above depending upon the viscosity or other physical properties of the reaction liquid desired, the reaction mode or other factors the like, but it is practically very difficult to select an appropriate agitating blade so as to satisfy the requirements formula (I) during agglomeration in the emulsion polymerization/agglomeration method. However, among the above agitating blades, a preferred blade is one which has a relatively large upper projected area relative to the side projected area, specifically a blade having a ratio of the upper projected area ($S_U$) to the side projected area ($S_S$) of $S_U$:$S_S$=5:1 to 1:1. Here, each projected area is measured at a part which is in contact with the mixed dispersion in a state where no stirring is conducted.

Specifically, a more preferred agitating blade is a helical blade. Among helical blades, preferred is a helical ribbon blade. Further, in the case of a helical ribbon blade, a single helical ribbon blade having a helical structure, a double helical ribbon blade having two helical structures, or a triple one or higher structured blade may be used, but preferred is a double helical ribbon blade when taking both stirring efficiency and productivity of a helical blade into consideration. A characteristic feature of the present invention is to carry out the agglomeration of the mixed dispersion in a stirring tank equipped with the double helical ribbon blade.

In a case of using a helical ribbon blade, the ratio of the width (blade diameter: d) to the length (L) including the pitch of the helical structure is preferably 1:1 to 1:2.

Further, a baffle is preferably positioned in the stirring tank for the purpose of securing uniformity of stirring. A baffle may be provided in the stirring tank so as not to be in contact with the blade, and in the case of a double helical ribbon blade, the baffle is preferably located at the inside of the helical structure (ribbon portion).

A double helical ribbon blade 6 rotates in a stirring tank by a rotation axis 7 connected to a driving gear (not shown) such as a motor. The stirring tank shown in FIG. 4 is equipped with a baffle 5 and a triangular baffle 8, which also plays a role in scraping a solid material attached to the rotation axis away.

The agglomeration of particles using a stirring tank equipped with a double helical ribbon blade, as a preferred embodiment of the present invention, is described in detail below. A double helical ribbon blade typically has the shape as illustrated in FIG. 4. The diameter (d) of the double helical ribbon blade may be changed at the upper part, the center part and the lower part of the blade depending upon the shape of the stirring tank. In a case of using an approximately cylindrical stirring tank, the diameter (d) of the double helical ribbon blade is preferably substantially constant in its upper part, the center part and the lower part of the blade.

In the event an approximately cylindrical stirring tank is used, with respect to the ratio of the diameter (d) of the double helical ribbon blade to the diameter (D) of the stirring tank, d/D preferably ranges from 0.9 to 0.98, more preferably from 0.95 to 0.97. A value of d/D of 1 indicates that the stirring tank and the double helical ribbon blade are in contact with each other, and accordingly, if the value of d/D is approximately 1, the stirring tank and the double helical ribbon blade may be in contact with each other in some cases, and if the value is significantly small, the stirring efficiency tends to decrease.

Further, the ribbon of the double helical ribbon blade has a width (b) and b/D preferably ranges from 0.08 to 0.15, more preferably from 0.1 to 0.12.

Further, in a case where the stirring tank is provided with a baffle, the shape of the baffle is preferably cylindrical or plate-like, and the baffle has a diameter (B) and, B/D preferably ranges from 0.05 to 0.15, more preferably from 0.08 to 0.1. Further, the tank may be provided with a plurality of baffles.

The rotation rate of the double helical ribbon blade depends on the size of the stirring tank or the blade, and in a case of an agglomeration tank having a capacity of about 1 $m^3$, the maximum rotation rate during the agglomeration step preferably ranges from 80 to 135 rpm, more preferably ranges from 100 to 130 rpm. The rotation rate of the blade may be changed in the middle of the agglomeration step, and when the coloring agent and the primary polymer particles are agglomerated, the-rotation rate preferably ranges from 80 to 135 rpm, more preferably from 100 to 130 rpm. At the stage of attaching fine resin particles to the agglomerates of particles, the rotation rate preferably ranges from 110 to 135 rpm, more preferably from 120 to 130 rpm.

In the case where the concentration of a solid in the mixed dispersion is high or the weight of the mixed dispersion is high, the mixed dispersion tends to bubble. In this situation it is most preferred to use a double helical ribbon blade. By using such a blade, it is easy to suppress bubbling, and it is also easy to maintain uniform stirring, even when little bubbling occurs. Use of a double helical ribbon blade is effective in the case where the concentration of solids in the mixed dispersion is at least 10% by weight, preferably at least 12% by weight, and most preferably at least 15% by weight. The upper limit of the concentration of the solid is usually 50% by weight or less, preferably 40% by weight or less. Using a double helical ribbon blade is also effective when the weight of the mixed dispersion is at least 10 kg, preferably at least 20 kg and most preferably 30 kg.

Another Compounding Ingredient

In the present invention, the surfaces of the agglomerates of particles after the agglomeration stage are preferably coated (attached or fixed) with fine resin particles as desired, to form toner particles.

In the case where the charge controlling agent is added after the agglomeration the charge controlling agent is preferably added to the dispersion containing agglomerates of particles, and then fine resin particles are added.

The fine resin particles are dispersed in water or a liquid composed mainly of water by an emulsifying agent, i.e., the above-mentioned surface active agent, and used as an emulsion. However, when the outermost layer of the toner is constituted of fine resin particles, preferred are particles which do not contain wax.

As the fine resin particles, preferred are particles having a volume average particle size ranging from 0.02 to 3 $\mu$m, more preferably ranging from 0.05 to 1.5 $\mu$m, and which are prepared by polymerizing a monomer similar to the monomers used for the primary polymer particles.

In a case of coating the agglomerates of particles with fine resin particles, the resin used for the fine resin particles is preferably a cross-linked one resin.

Aging Step

In the method of the present invention, the agglomeration step is preferably followed by an aging step in which the agglomerates of particles are fused at a temperature within the range of preferably from (Tg+20° C.) to (Tg+80° C.) in the same stirring tank used for the agglomeration step.

The stirring rotation rate in the aging step preferably ranges from 40 to 100 rpm, more preferably from 50 to 80 rpm.

Further, it is preferred to conduct an aging treatment which causes fusion of agglomerated particles, at a temperature within the range of (Tg+20° C.) to (Tg+80° C.) in order to increase stability of the agglomerates of particles (toner particles) prepared by agglomeration. By carrying out the aging step, it is possible to bring the shape of the toner particles close to spheres, and shape control becomes possible. This aging step is conducted usually from 1 to 24 hours, preferably from 2 to 10 hours.

It is believed that the agglomerates of particles before the aging step are aggregates of the primary particles due to electrostatic or other physical agglomeration, but after the aging step, the primary polymer particles constituting the agglomerates of particles are fused to each other, and preferably substantially spherical. According to this method of producing a toner, toners having various shapes can be produced depending upon the use intended, such as grape type agglomerates wherein primary particles are agglomerated, potato type agglomerates wherein fusion is halfway conducted, and spherical type agglomerates wherein fusion is further accomplished.

Further, the ratio of the volume average particle size ($D_V$) to the number average particle size ($D_N$) of the toner thus prepared is preferably $D_V/D_N$=1 to 1.6, more preferably $D_V/D_N$=1 to 1.5. The method for producing a toner of the present invention is particularly effective in producing such a toner having an excellent particle size distribution.

Further, the sphericity of the toner particles is preferably from 0.95 to 1, more preferably from 0.96 to 0.99, and this can be achieved by carrying out the above aging step.

Washing and Drying Step

The agglomerates of particles obtained by the above steps are subjected to solid-liquid separation according to a known method, and the agglomerates of particles are recovered, and washed and dried as desired to prepare the desired toner particles.

The toner particles to be obtained have a sharp particle size distribution even though they have a volume average particle size of as small as from 3 to 9 $\mu$m, and are suitable for an electrostatic image developing toner to achieve a high picture quality and a high printing speed.

Having now generally described this invention, a further understanding can be obtained by reference to certain specific examples which are provided herein for purposes of illustration only and are not intended to be limiting unless otherwise specified.

In Examples, "part(s)" means "part(s) by weight". Further, the average particle size of the agglomerates of particles was measured using a laser diffraction type particle size distribution meter SALD2000J manufactured by Shimadzu Corporation.

Preparation of a Dispersion of Primary Polymer Particles

Into a reactor made of glass equipped with a stirring device, a heating and cooling device, a concentrating device and a device for introducing materials and assistants, 0.268 part of sodium dodecylbenzenesulfonate (hereinafter referred to simply as DBS) and 367 parts of deionized water were introduced, and the temperature was raised to 90° C. in a stream of nitrogen.

Then, the following initiator (1) was added, as well as the following monomers, DBS, 1% nonionic surface active agent and deionized water were added over a period of 5 hours, and the following initiator (2) was added over a period of 6 hours to conduct emulsion polymerization.

| | |
|---|---|
| Monomers | |
| Styrene: | 79 parts |
| Butyl acrylate: | 21 parts |
| Acrylic acid: | 3 parts |
| Trichlorobromomethane: | 0.5 part |
| Emulsifying agent | |
| Sodium dodecylbenzenesulfonate: | 0.27 part |
| 1% nonionic surface active agent: | 0.01 part |
| Deionized water | 22 parts |
| Initiator (1) | |
| 8% aqueous hydrogen peroxide solution: | 0.13 part |
| 8% aqueous ascorbic acid solution: | 0.13 part |
| Initiator (2) | |
| 8% aqueous hydrogen peroxide solution: | 0.72 part |
| 8% aqueous ascorbic acid solution: | 0.72 part |

After completion of the polymerization reaction, the mixture was cooled to prepare a milk-white dispersion (A) of primary polymer particles. The prepared emulsion had an average particle size of 188 nm (as measured by UPA manufactured by Microtrac), the polymer had a Mw of 71,000 and Mp of 54,000, and the primary polymer particles had a Tg of 68° C.

EXAMPLES

Example 1

Production of a Toner: Coagglomeration of Wax and Polymer Primary Particles

| | |
|---|---|
| Dispersion (A) of primary polymer particles: | 100 parts (solid content) |
| Blue pigment EP700 Blue GA (30% dispersion: manufactured by Dainichiseika Colour & Chemicals Mfg. Co., Ltd.): | 6.7 parts (solid content) |
| Wax HYTEC E-433N (30% dispersion: manufactured by Toho Chemical Industry Co., Ltd.): | 5 parts (solid content) |
| Charge controlling agent: 20% dispersion of 4,4'-methylenebis[2-N-(4-chlorophenyl) amide]-3-hydroxynaphthalene]: | 0.1 part (solid content) |

A double helical ribbon blade equipped with two inside ϕ 10 round bar baffles: blade diameter 90 mm; blade width 9 mm; rotation rate of 500 rpm was positioned in a glass separatory flask (inner diameter 100 mm×height 300 mm) agglomeration tank, and while stirring the mixture of the above dispersions with the double helical ribbon blade in order to effect dispersion, the dispersion was heated from 25° C. to 60° C. at 1° C./min and held at 60° C. for 2 hours with stirring and further held at 65° C. for 2 hours with stirring. A charge controlling agent was then added thereto, and the mixture was held at 72° C. for 1 hour with stirring, further held at 80° C. for 1 hour with stirring, and still further held at 90° C. for 1 hour with stirring.

The volume average particle size of the agglomerate obtained was measured by a laser diffraction type particle size distribution meter at each temperature. The particle size was about 5.8 , μm and the particle sizes were stable at from 65 to 90° C. In the temperature-increasing step, the particle sizes were not changed and uniform stirring and mixing were conducted. Further, the agglomerates had a narrow particle size distribution and small particle sizes and the involvement of bubbles during thickening was small.

Comparative Example 1

The agglomeration step was conducted in the same manner as described Example 1 except that an anchor blade (blade diameter 93 mm; blade width 10 mm; rotation number 480 rpm) was used instead of the double helical ribbon blade used in Example 1. The volume average particle size was 20.0 μm at 90° C., the agglomerates had a broad particle size distribution and large particle sizes, and the mixing was not uniformly conducted. Further, bubbles were involved, the thickening was too intense, and the agitating blade alone ran idle.

Comparative Example 2

The agglomeration step was conducted in the same manner as described in Example 1 except a Hi-F mixer blade (blade diameter 62 mm; rotation number 610 rpm) was used instead of the double helical ribbon blade used in Example 1. The volume average particle size was 11.7 μm at 90° C., the agglomerates had a broad particle size distribution and large particle sizes, and the mixing was not uniformly conducted. Further, bubbles were involved, the thickening was too intense, and the agitating blade alone ran idle.

Comparative Example 3

The agglomeration step was conducted in the same manner as described in Example 1 except that a Summeller blade (blade diameter 60 mm; rotation number 630 rpm) was used instead of the double helical ribbon blade used in Example 1. The volume average particle size was 10.8 μm at 90° C., the agglomerates had a broad particle size distribution and large particle sizes, and the mixing was not uniformly conducted. Further, bubbles were involved, the thickening was too intense, and the agitating blade alone ran idle.

Example 2

Wax Dispersion (1)

An amount of 68.33 parts of demineralized water, 30 parts of a mixture comprising an ester mixture consisting essentially of behenyl behenate (Unistar M-2222SL, manufactured by NOF Corporation) and an ester mixture consisting essentially of steary stearate (Unistar M9676, manufactured by NOF Corporation) in a ratio of 7:3, and 1.67 parts of sodium dodecylbenzenesulfonate (Neogen SC, manufactured by Dai-ichi Kogyo Seiyaku Co., Ltd., active ingredient 66%) were mixed, and high pressure shear was applied thereto at 90° C. for emulsification, thereby preparing a dispersion of fine ester wax particles. The average particle size of the fine ester wax particles was 340 nm as measured by LA-500.

Dispersion of Polymer Primary Particles (1)

Into a reactor (capacity 60 liter, inner diameter 400 mm) equipped with a stirring device (three-bladed), a heating and cooling device, a concentrating device and a device for introducing materials and assistants, 28 parts of the wax dispersion (1), 1.2 parts of a 15% aqueous Neogen SC solution and 393 parts of demineralized water were introduced. The temperature was raised to 90° C. in a stream of nitrogen, and 1.6 parts of a 8% aqueous hydrogen peroxide solution and 1.6 parts of a 8% aqueous ascorbic acid solution were added thereto.

Then, a mixture of the following monomers and aqueous emulsifying agent solution was added thereto over a period of 5 hours from the start of the polymerization. The following aqueous initiator solution was added thereto over a period of 6 hours from the start of the polymerization, and the mixture was further held for 30 minutes.

| | |
|---|---|
| Monomers | |
| Styrene: | 79 parts (5,530 g) |
| Butyl acrylate: | 21 parts |
| Acrylic acid: | 3 parts |
| Octanethiol: | 0.38 part |
| 2-Mercaptoethanol: | 0.01 part |
| Hexanediol diacrylate: | 0.9 part |
| Aqueous emulsifying agent solution | |
| 15% aqueous Neogen SC (sodium dodecylbenzenesulfonate) solution: | 1 part |
| Demineralized water: | 25 parts |
| Aqueous initiator solution | |
| 8% aqueous hydrogen peroxide solution: | 9 parts |
| 8% aqueous ascorbic acid solution: | 9 parts |

After the completion of the polymerization reaction, the mixture was cooled thereby preparing a milk-white polymer dispersion. The weight average molecular weight of the THF soluble component of the polymer was 119,000, the average particle size was 189 nm as measured by UPA, and Tg was 57° C.

Dispersion of Fine Resin Particles (1)

Into a reactor (capacity 60 liter, inner diameter 400 mm) equipped with a stirring device (three-bladed), a heating and cooling device, a concentrating device and a device for introducing materials and assistants, 5 parts of a 15% aqueous Neogen SC solution and 372 parts of demineralized water were introduced, the temperature was raised to 90° C. in a stream of nitrogen, and 1.6 parts of a 8% aqueous hydrogen peroxide solution and 1.6 parts of a 8% aqueous ascorbic acid solution were added thereto.

Then, a mixture of the following monomers and aqueous emulsifying agent solution was added thereto over a period of 5 hours from the start of the polymerization, and the following aqueous initiator solution was added thereto over a period of 6 hours from the start of the polymerization. The mixture was further held for 30 minutes.

| | |
|---|---|
| Monomers | |
| Styrene: | 88 parts (6,160 g) |
| Butyl acrylate: | 12 parts |
| Acrylic acid: | 2 parts |
| Bromotrichloromethane | 0.5 part |
| 2-Mercaptoethanol: | 0.01 part |
| Hexanediol diacrylate: | 0.4 part |
| Aqueous emulsifying agent solution | |
| 15% aqueous Neogen SC solution: | 2.5 parts |
| Demineralized water: | 24 parts |
| Aqueous initiator solution | |
| 8% aqueous hydrogen peroxide solution: | 9 parts |
| 8% aqueous ascorbic acid solution: | 9 parts |

After the completion of the polymerization reaction, the mixture was cooled thereby preparing a milk-white polymer dispersion. The weight average molecular weight of the THF soluble component of the polymer was 54,000, the average particle size was 83 nm as measured by UPA, and Tg was 85° C.

Dispersion of Fine Particles of a Coloring Agent (1)

A water dispersion of pigment blue 15:3 (EP-700 Blue GA, manufactured by Dainichi Seika Colour & Chemicals Mfg. Co., Ltd., solid content 35%) had an average particle size of 150 nm as measured by UPA.

Dispersion of Fine Particles of a Charge Controlling Agent (1)

An amount of 20 parts of 4,4'-methylenebis[2-[N-(4-chlorophenyl)amide]-3-hydroxynaphthalene], 4 parts of alkylnaphthalene sulfonate and 76 parts of demineralized water were dispersed by a sand grinder mill thereby preparing a dispersion of fine particles of a charge controlling agent. The average particle size was 200 nm as measured by UPA.

| Production of a developing toner (1) | |
|---|---|
| Dispersion of primary polymer particles (1): | 104.5 parts (as a solid content) (23.74 kg) |
| Dispersion of fine resin particles (1): | 5.5 parts (as a solid content) |
| Dispersion of fine particles of a coloring agent (1): | 6.7 parts (as a solid content) |
| Dispersion of fine particles of a charge controlling agent (1): | 2 parts (as a solid content) |
| 15% aqueous Neogen SC solution: | 0.65 part (as a solid content) |

Using the above components, a toner was produced according to the following procedure.

The dispersion of primary polymer particles and the 15% aqueous Neogen SC solution were introduced into a reactor (capacity 60 liter, inner diameter 400 mm×height 750 mm, double helical ribbon blade equipped with a baffle) and uniformly mixed at a stirring rotation rate of 90 rpm, and the dispersion of fine particles of a coloring agent was added thereto to prepare a mixed dispersion. While stirring the prepared mixed dispersion (rotation rate 190 rpm), an aqueous aluminum sulfate solution (0.6 part as a solid content) was dropwise added thereto. Then, the mixture was heated to 55° C. over a period of 40 minutes with stirring and held for 1 hour with stirring, and then further heated to 58° C. over a period of 10 minutes and held for 40 minutes with stirring. The dispersion of fine particles of a charge controlling agent, the dispersion of fine resin particles and an aqueous aluminum sulfate solution (0.07 part as a solid content) were added thereto, and the 15% aqueous Neogen SC solution (3 parts as a solid content) was added thereto, and the mixture was heated to 95° C. over a period of 60 minutes and held at 95° C. for 2 hours with stirring to prepare a toner having a volume average particle size of 7.5 μm. Then, the toner was cooled, subjected to filtration, washed with water and dried to prepare a toner.

With 100 parts of this toner, 0.6 part of a silica having a hydrophobic surface treatment applied thereto was mixed and stirred to prepare a developing toner.

Evaluation of the Toner (1)

Of the developing toner, the volume average particle size was 7.5 μm as measured by Coulter counter, the proportion of particles having volume particle sizes of at most 5 μm was 5.4%, the proportion of particles having volume particle sizes of at least 15 μm was 14.5%, and the ratio of the volume average particle size to the number average particle size was 1.4. The 50% sphericity was 0.96.

With respect to the fixation property of the developing toner (1), the toner was fixed at from 180 to 200° C. at a fixation rate of 120 mm/S, and at from 130 to 180° C. at a fixation rate of 30 mm/S.

The amount of toner charged (1) was +2 μC/g, and the amount of the charge developing toner was −2 μC/g.

Example 3

Wax Dispersion (2)

An amount of 68.33 parts of demineralized water, 30 parts of a mixture comprising an ester mixture consisting essentially of behenyl behenate (Unistar M-2222SL, manufactured by NOF Corporation) and an ester mixture consisting essentially of steary stearate (Unistar M9676, manufactured by NOF Corporation) in a ratio of 7:3, and 1.67 parts of sodium dodecylbenzenesulfonate (Neogen SC, manufactured by Dai-ichi Kogyo Seiyaku Co., Ltd., active ingredient 66%) were mixed. A high pressure shear was applied thereto at 90° C. for emulsification, to prepare a dispersion of fine ester wax particles. The average particle size of the fine ester wax particles was 340 nm as measured by LA-500.

Dispersion of Primary Polymer Particles (2)

Into a reactor (capacity 2.5 $m^3$, inner diameter 1,400 mm) equipped with a stirring device (Maxblend blade), a heating and cooling device, a concentrating device and a device for introducing materials and assistants, 28 parts of the wax dispersion (1), 1.2 parts of a 15% aqueous Neogen SC solution and 393 parts of demineralized water were introduced. The temperature was raised to 90° C. in a stream of nitrogen, and 1.6 parts of a 8% aqueous hydrogen peroxide solution and 1.6 parts of a 8% aqueous ascorbic acid solution were added thereto.

Then, a mixture of the following monomers and aqueous emulsifying agent solution was added thereto over a period of 5 hours from the start of the polymerization, and the following aqueous initiator solution was added thereto over a period of 6 hours from the start of the polymerization, and the mixture was further held for 30 minutes.

| Monomers | |
|---|---|
| Styrene: | 79 parts (221.2 kg) |
| Butyl acrylate: | 21 parts |
| Acrylic acid: | 3 parts |
| Octanethiol: | 0.38 part |

-continued

| | |
|---|---|
| 2-Mercaptoethanol: | 0.01 part |
| Hexanediol diacrylate: | 0.9 part |
| Aqueous emulsifying agent solution | |
| 15% aqueous Neogen SC solution: | 1 part |
| Demineralized water: | 25 parts |
| Aqueous initiator solution | |
| 8% aqueous hydrogen peroxide solution: | 9 parts |
| 8% aqueous ascorbic acid solution: | 9 parts |

After the completion of the polymerization reaction, the mixture was cooled to prepare a milk-white polymer dispersion. The weight average molecular weight of the THF soluble component of the polymer was 119,000, the average particle size was 189 nm as measured by UPA, and Tg was 57° C.

Dispersion of Fine Resin Particles (2)

Into a reactor (capacity 2.5 $m^3$, inner diameter 1,400 mm) equipped with a stirring device (Maxblend blade), a heating and cooling device, a concentrating device and a device for introducing materials and assistants, 5 parts of a 15% aqueous Neogen SC solution and 372 parts of demineralized water were introduced, the temperature was raised to 90° C. in a stream of nitrogen, and 1.6 parts of a 8% aqueous hydrogen peroxide solution and 1.6 parts of a 8% aqueous ascorbic acid solution were added thereto.

Then, a mixture of the following monomers and aqueous emulsifying agent solution was added thereto over a period of 5 hours from the start of the polymerization, and the following aqueous initiator solution was added thereto over a period of 6 hours from the start of the polymerization, and the mixture was further held for 30 minutes.

| Monomers | |
|---|---|
| Styrene: | 88 parts (276.5) |
| Butyl acrylate: | 12 parts |
| Acrylic acid: | 2 parts |
| Bromotrichloromethane | 0.5 part |
| 2-Mercaptoethanol: | 0.01 part |
| Hexanediol diacrylate: | 0.4 part |
| Aqueous emulsifying agent solution | |
| 15% aqueous Neogen SC solution: | 2.5 parts |
| Demineralized water: | 24 parts |
| Aqueous initiator solution | |
| 8% aqueous hydrogen peroxide solution: | 9 parts |
| 8% aqueous ascorbic acid solution: | 9 parts |

After the completion of the polymerization reaction, the mixture was cooled to prepare a milk-white polymer dispersion. The weight average molecular weight of the THF soluble component of the polymer was 54,000, the average particle size was 83 nm as measured by UPA, and Tg was 85° C.

Dispersion of Fine Particles of a Coloring Agent (2)

A water dispersion of pigment blue 15:3 (EP-700 Blue GA, manufactured by Dainichi Seika Colour & Chemicals Mfg. Co., Ltd., solid content 35%) had an average particle size of 150 nm as measured by UPA.

Dispersion of Fine Particles of a Charge Controlling Agent (2)

An amount of 20 parts of 4,4'-methylenebis[2-[N-(4-chlorophenyl)amide]-3-hydroxynaphthalene], 4 parts of alkylnaphthalene sulfonate and 76 parts of demineralized water were dispersed by a sand grinder mill to prepare a dispersion of fine particles of a charge controlling agent. The average particle size was 200 nm as measured by UPA.

| Production of a developing toner (2) | |
|---|---|
| Dispersion of polymer primary particles (2): | 102.7 parts (as a solid content) (300 kg) |
| Dispersion of fine resin particles (2): | 5 parts (as a solid content) |
| Dispersion of fine particles of a coloring agent (2): | 6.7 parts (as a solid content) |
| Dispersion of fine particles of a charge controlling agent (2): | 2 parts (as a solid content) |
| 15% aqueous Neogen SC solution: | 0.65 part (as a solid content) |

Using the above components, a toner was produced according to the following procedure.

The dispersion of polymer primary particles and the 15% aqueous Neogen SC solution were introduced into a reactor (capacity 1,000 liter, inner diameter 850 mm×height 1,800 mm, double helical blade equipped with a baffle) and uniformly mixed at a stirring rotation rate of 110 rpm, and the dispersion of fine particles of a coloring agent was added thereto to prepare a mixed dispersion. While stirring the prepared mixed dispersion (rotation rate 127 rpm), an aqueous aluminum sulfate solution (0.6 part as a solid content) was dropwise added thereto. Then, the mixture was heated to 55° C. over a period of 60 minutes with stirring (rotation rate 127 rpm) and held at 55° C. for 1 hour with stirring , and then further heated to 57° C. over a period of 10 minutes and held at 59° C. for 40 minutes with stirring. The dispersion of fine particles of a charge controlling agent, the dispersion of fine resin particles and an aqueous aluminum sulfate solution (0.07 part as a solid content) were added thereto, and the 15% aqueous Neogen SC solution (3 parts as a solid content) was added thereto. The mixture was heated to 95° C. over a period of 60 minutes and held at 95° C. for 3 hours with stirring to obtain a toner having a volume average particle size of 7.3 μm. Then, the toner was cooled, subjected to filtration, washed with water and dried to thereby preparing a toner.

With 100 parts of this toner, 0.6 part of a silica having a hydrophobic surface treatment applied thereto was mixed and stirred to prepare a developing toner.

Evaluation of the Toner (2)

As to the developing toner, the volume average particle size was 7.3 μm as measured by a Coulter counter, and the ratio of the volume average particle size to the number average particle size was 1.2. The 50% sphericity was 0.96.

With respect to the fixation property of the developing toner, the toner was fixed at a temperature from 180 to 200° C. at a fixation rate of 120 mm/S, and at a-temperature from 130 to 180° C. at a fixation rate of 30 mm/S.

The charged amount of toner was +1 μC/g, and the amount of the charge developing toner was −5 μC/g.

Values of $H_C$ and $H_E$, the average particle size when the agglomeration was finished, as measured by a laser diffraction type particle size distribution meter SALD2000J manufactured by Shimadzu Corporation, and the ratio of the volume average particle size to the number average particle size in Examples and Comparative Examples are shown in Table 1.

Further, the shapes of the double helical ribbon blades used in Examples 1 to 3 are shown in Table 2.

TABLE 1

| | Agitating blade | Volume average particle size | $D_V/D_N$ | $H_C$ | $H_E$ |
|---|---|---|---|---|---|
| Ex. 1 Lab. | Double helical | 5.8 μm | 1.42 | 0.1 H | 2.5 H |
| Ex. 2 Bench | Double helical | 7.5 | 1.40 | 0.1 H | 2.5 H |
| Ex. 3 Pilot | Double helical | 7.3 | 1.20 | 0.1 H | 2.5 H |
| Comp. Ex. 1 | Anchor | 20.0 | 1.48 | 3 H | 3 H |
| Comp. Ex. 2 | Hi-F mixer | 11.7 | 1.65 | 3 H | 3 H |
| Comp. Ex. 3 | Summeller | 10.8 | 1.71 | 3 H | 3 H |

TABLE 2

| Shape of the helical blade | Ex. 1 | Ex. 2 | Ex. 3 |
|---|---|---|---|
| d/D | 0.93 | 0.95 | 0.96 |
| L/D | 0.5 | 0.5 | 0.5 |
| b/D | 0.1 | 0.1 | 0.1 |
| B/D | 0.09 | 0.09 | 0.09 |
| Stirring tank inner diameter (D) | 123 mm | 400 mm | 850 mm |
| Blade diameter (d) | 115 mm | 380 mm | 820 mm |
| Length of ribbon including one pitch (L) | 57 mm | 190 mm | 410 mm |
| Blade width (b) | 12 mm | 40 mm | 85 mm |
| Baffle diameter (B) | 10 mm | 35 mm | 76.3 mm |

The disclosures of Japanese priority Application No. 2000-053145 filed Feb. 29, 2000 and Japanese priority Application No. 096750/2000 filed Mar. 31, 2000 are hereby incorporated by reference into the present application.

Obviously, numerous modifications and variations of the present invention are possible in light of the above teachings. It is, therefore, to be understood that within the scope of the appended claims, the invention may be practiced otherwise than as specifically described herein

What is Claimed as new and is Intended to be Secured by Letters Patent is:

1. A method for producing an electrostatic image developing toner, which comprises:

stirring with a double helical ribbon blade as an agitating blade a dispersion containing at least primary polymer particles and coloring agent particles in a stirring tank, thereby agglomerating the particles, wherein the shape of the liquid level during the stirring operation satisfies the following formulae (I) and (II):

$$H_C \leqq 0.8H \quad \text{(I)},$$

$$1.2H \leqq H_E \quad \text{(II)}$$

H: the distance between the bottom of the stirring tank at its center and the horizontal plane of the surface of the dispersion before the start of the stirring, $H_C$: the distance between the bottom of the stirring tank at its center and the liquid level of the surface of the dispersion at its center during stirring, and $H_E$: the distance between the bottom of the stirring tank at its center and the liquid level of the surface of the dispersion at the edge of the tank during stirring.

2. The method for producing an electrostatic image developing toner according to claim 1, wherein the agglomeration is effected by heating the dispersion to prepare the agglomerates of particles.

3. The method for producing an electrostatic image developing toner according to claim 1, wherein an electrolyte is added to the dispersion for agglomeration.

4. The method for producing an electrostatic image developing toner according to claim 1, wherein the agglomeration is followed by aging the agglomerated particles to fuse the agglomerates.

5. The method for producing an electrostatic image developing toner according to claim 4, wherein the aging is conducted by holding the dispersion at a temperature within the range of (Tg+20° C.) to (Tg+80° C.) for at least 1 hour, wherein the Tg value is the glass transition temperature of the primary polymer particles.

6. The method for producing an electrostatic image developing toner according to claim 1, wherein the primary polymer particles are ones prepared by emulsion polymerization.

7. The method for producing an electrostatic image developing toner according to claim 6, wherein the primary polymer particles have a glass transition temperature ranging from 40 to 80° C.

8. The method for producing an electrostatic image developing toner according to claim 6, wherein the primary polymer particles have an average particle size of ranging from 0.02 to 3 $\mu$m.

9. The method for producing an electrostatic image developing toner according to claim 6, wherein the primary polymer particles are ones prepared by seed polymerization of a monomer in the presence of fine wax particles.

10. The method for producing an electrostatic image developing toner according to claim 1, wherein the dispersion further contains fine particles of a charge controlling agent in addition to the primary polymer particles and the coloring agent particles.

11. The method for producing an electrostatic image developing toner according to claim 1, which comprises preparing agglomerates of particles by stirring a mixed dispersion containing at least primary polymer particles and coloring agent particles in a stirring tank to agglomerate the particles, and mixing at least fine particles of a charge controlling agent therein in order to adhere the fine particles of a charge controlling agent to the agglomerates of particles.

12. The method for producing an electrostatic image developing toner according to claim 1, which comprises preparing agglomerates of particles by stirring a mixed dispersion containing at least primary polymer particles and coloring agent particles in a stirring tank in order to agglomerate the particles, and mixing at least fine resin particles therein in order to adhere the fine resin particles to said agglomerates of particles.

13. The method for producing an electrostatic image developing toner according to claim 1, which comprises preparing agglomerates of particles by stirring a mixed dispersion containing at least primary polymer particles and coloring agent particles in a stirring tank in order to agglomerate the particles, and mixing at least fine particles of a charge controlling agent and fine resin particles therein in order to adhere the particles of a charge controlling agent and the fine resin particles to said agglomerates of particles.

14. The method for producing an electrostatic image developing toner according to claim 13, wherein the adhesion of fine resin particles to the agglomerated particles is followed by aging in which the agglomerates of particles are fused.

15. The method for producing an electrostatic image developing toner according to claim 14, wherein the aging is conducted by holding the dispersion at a temperature within the range of (Tg+20° C.) to (Tg+80° C.) for at least 1 hour, wherein the Tg value is the glass transition temperature of the primary polymer particles.

16. The method for producing an electrostatic image developing toner according to claim 1, wherein the dispersion is held at a temperature within a range from (Tg+20° C.) to Tg for at least 30 minutes in the agglomeration, wherein the Tg value is the glass transition temperature of the primary polymer particles.

17. The method for producing an electrostatic image developing toner according to claim 16, wherein the toner has a sphericity ranging from 0.95 to 1.

18. The method for producing an electrostatic image developing toner according to claim 1, wherein the toner has a volume average particle size ($D_V$) ranging from 3 to 9 $\mu$m.

19. The method for producing an electrostatic image developing toner according to claim 1, wherein the toner has a ratio of the volume average particle size ($D_V$) to the number average particle size ($D_N$) of $D_V/D_N$=1 to 1.6.

20. The method for producing an electrostatic image developing toner according to claim 1, wherein stirring in the tank is effected by a double helical ribbon blade which suppresses bubbling of the dispersion.

21. The method for producing an electrostatic image developing toner according to claim 1, wherein the solids content of the dispersion is at least 10% to at most 50% by weight.

22. The method for producing an electrostatic image developing toner according to claim 1, wherein the weight of the mixed dispersion is at least 10kg.

23. A method for producing an electrostatic image developing toner, which comprises:

stirring a dispersion containing at least primary polymer particles and coloring agent particles in a stirring tank in order to agglomerate the particles, wherein the contents of the tank are stirred with a double helical ribbon blade as an agitating blade.

24. The method for producing an electrostatic image developing toner according to claim 23, wherein the ratio of the diameter (d) of the double helical ribbon blade to the diameter (D) of a cylindrical stirring tank is d/D=0.9 to 0.98.

25. The method for producing an electrostatic image developing toner according to claim 23, wherein the ratio of the width (b) of the ribbon of the double helical ribbon blade to the diameter (D) of a cylindrical stirring tank is b/D=0.08 to 0.15.

26. The method for producing an electrostatic image developing toner according to claim 23, wherein the toner has a volume average particle size ($D_V$) ranging from 3 to 9 $\mu$m.

27. The method for producing an electrostatic image developing toner according to claim 23, wherein the toner has a ratio of the volume average particle size ($D_V$) to the number average particle size ($D_N$) of $D_V/D_N$=1 to 1.6.

28. The method for producing an electrostatic image developing toner according to claim 23, wherein the agglomeration is effected by heating the dispersion to prepare the agglomerates of particles.

29. The method for producing an electrostatic image developing toner according to claim 23, wherein an electrolyte is added to the dispersion for agglomeration.

30. The method for producing an electrostatic image developing toner according to claim 23, wherein the agglomeration step is followed by an aging the agglomerated particles to fuse the agglomerates.

31. The method for producing an electrostatic image developing toner according to claim 23, wherein the primary polymer particles are obtained by emulsion polymerization.

32. The method for producing an electrostatic image developing toner according to claim 31, wherein the primary polymer particles have a glass transition temperature ranging from 40 to 80° C.

33. The method for producing an electrostatic image developing toner according to claim 31, wherein the primary polymer particles have an average particle size ranging from 0.02 to 3 $\mu$m.

34. The method for producing an electrostatic image developing toner according to claim 31, wherein the primary polymer particles are prepared by seed polymerization of a monomer in the presence of fine wax particles.

35. The method for producing an electrostatic image developing toner according to claim 23, wherein the weight of the mixed dispersion is at least 10 kg.

36. The method for producing an electrostatic image developing toner according to claim 23, which comprises preparing agglomerates of particles by stirring a mixed dispersion containing at least primary polymer particles and coloring agent particles in a stirring tank in order to agglomerate the particles, and mixing at least fine particles of a charge controlling agent and fine resin particles therein in order to adhere the particles of a charge controlling agent and the fine resin particles to said agglomerates of particles.

37. The method for producing an electrostatic image developing toner according to claim 36, wherein the adhesion of fine resin particles to the agglomerated particles is followed by aging in which the agglomerates of particles are fused.

38. The method for producing an electrostatic image developing toner according to claim 23, wherein the agglomeration is followed by aging of the agglomerates by holding the dispersion at a temperature within the range of (Tg+20° C.) to (Tg+80° C.) for at least 1 hour, wherein the Tg value is the glass transition temperature of the primary polymer particles.

39. A method for producing an electrostatic image developing toner, which comprises:

stirring a dispersion containing at least primary polymer particles and coloring agent particles in a stirring tank equipped with a double helical ribbon blade for agitation of the contents of the tank while suppressing bubbling of the dispersion in the agglomeration of the particles, wherein the solids content of the dispersion is at least 10% to at most 50% by weight.

40. The method for producing an electrostatic image developing toner according to claim 39, wherein the weight of the mixed dispersion is at least 10 kg.

* * * * *